US006199439B1

(12) United States Patent
Lin

(10) Patent No.: US 6,199,439 B1
(45) Date of Patent: Mar. 13, 2001

(54) SIMPLE DEVICE PRODUCING BOTH ACTION EFFECT AND ELECTRONIC EFFECT

(76) Inventor: Lisa Lin, 5/F, No. 8, Alley 5, Lane 265 Sec. 4, Hsin Yi Road, Taipei (TW)

( * ) Notice: Subject to any disclaimer, the term of this patent is extended or adjusted under 35 U.S.C. 154(b) by 0 days.

(21) Appl. No.: 09/281,431

(22) Filed: Mar. 30, 1999

(30) Foreign Application Priority Data

Mar. 10, 1999 (TW) ..... 88203571

(51) Int. Cl.[7] ..... F03G 1/10; A63H 33/26; A63H 11/02

(52) U.S. Cl. ..... 74/61; 74/86; 40/455; 185/39; 185/DIG. 1; 446/3; 446/484; 446/485

(58) Field of Search ..... 74/61, 86; 40/411, 40/455; 446/3, 484, 485; 185/39, DIG. 1

(56) References Cited

U.S. PATENT DOCUMENTS 4,524,437 * 6/1985 Koike ..... 369/67
5,367,505 * 11/1994 Tsuchiya et al. ..... 368/72
5,789,716 * 8/1998 Wang ..... 200/61.45 R
5,853,315 * 12/1998 Satoh ..... 446/301

* cited by examiner

*Primary Examiner*—Allan D. Herrmann
(74) *Attorney, Agent, or Firm*—Bacon & Thomas, PLLC

(57) ABSTRACT

A simple device producing both action effect and electronic effect includes a housing, an elastic driving mechanism and an electronic control circuit with a vibration sensor. The elastic driving mechanism has an elastic member, a transmitting shaft, a power input device, an eccentric action member. The electronic cir-control circuit has a circuit board, the vibration sensor, a battery and a function device. The elastic member stores and releases energy, and a changed energy is produced in the storing and releasing process. The eccentric member is connected to the output shaft of the elastic driving mechanism and rotated by the changed energy to produce vibration or jumping phenomenon. Then the vibration sensor senses the vibration phenomenon and triggers a signal of changing its own condition and starts the electronic circuit to produce function to let the function device perform preset action or function.

4 Claims, 6 Drawing Sheets

SIMPLE DEVICE PRODUCING BOTH ACTION EFFECT AND ELECTRONIC EFFECT

BACKGROUND OF THE INVENTION

This invention relates to a simple device producing both an action effect and an electronic effect, particularly to one provided with an elastic driving mechanism with an eccentric action member for producing vibration or jumping action, and at the same time indirectly triggering a vibration sensor to the operation of an electronic control circuit.

A conventional method for producing action and starting an electronic circuit at the same time is effected by a switch to turn on a separated power source of a motor and an electronic circuit for producing action driven by the motor and driven by the electronic circuit. In other words, the action driven by the motor is practical movement such as tottering, slowly sliding, running and scrawling, wheel moving, jumping, vibrating, etc., all accomplished by a motor in conjunction with different mechanical designs. They are called action effect, guided by action phenomenon. Action driven by the electronic circuit is phenomenon such as sound, dialogue, lighting, flashing, and practical movement. They are called electronic effect, as driven by the electronic circuit. A motor and an electronic circuit combined together are the most popular conventional design, having a rather high cost owing to large current consumed by a motor using a large ordinary battery or storage battery. This involves disadvantage to environment, a large dimension, and the heavy weight of a motor and a battery, which makes it impossible to lessen the cost of a whole toy.

SUMMARY OF THE INVENTION

In order to improve the disadvantages of the conventional design of a motor and an electronic circuit combined together for producing both action effect and electronic effect, an integrated circuit (IC) is used and triggered by the same power source used to drive a motor and an electronic circuit at the same time. Thus the disadvantage of using two separate power sources can be improved.

The main purpose of the invention is to offer a simple device that is easy to assemble and has a wide scope of application for and producing both action effect and electronic effect at the same time, by means of triggering the electronic circuit.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
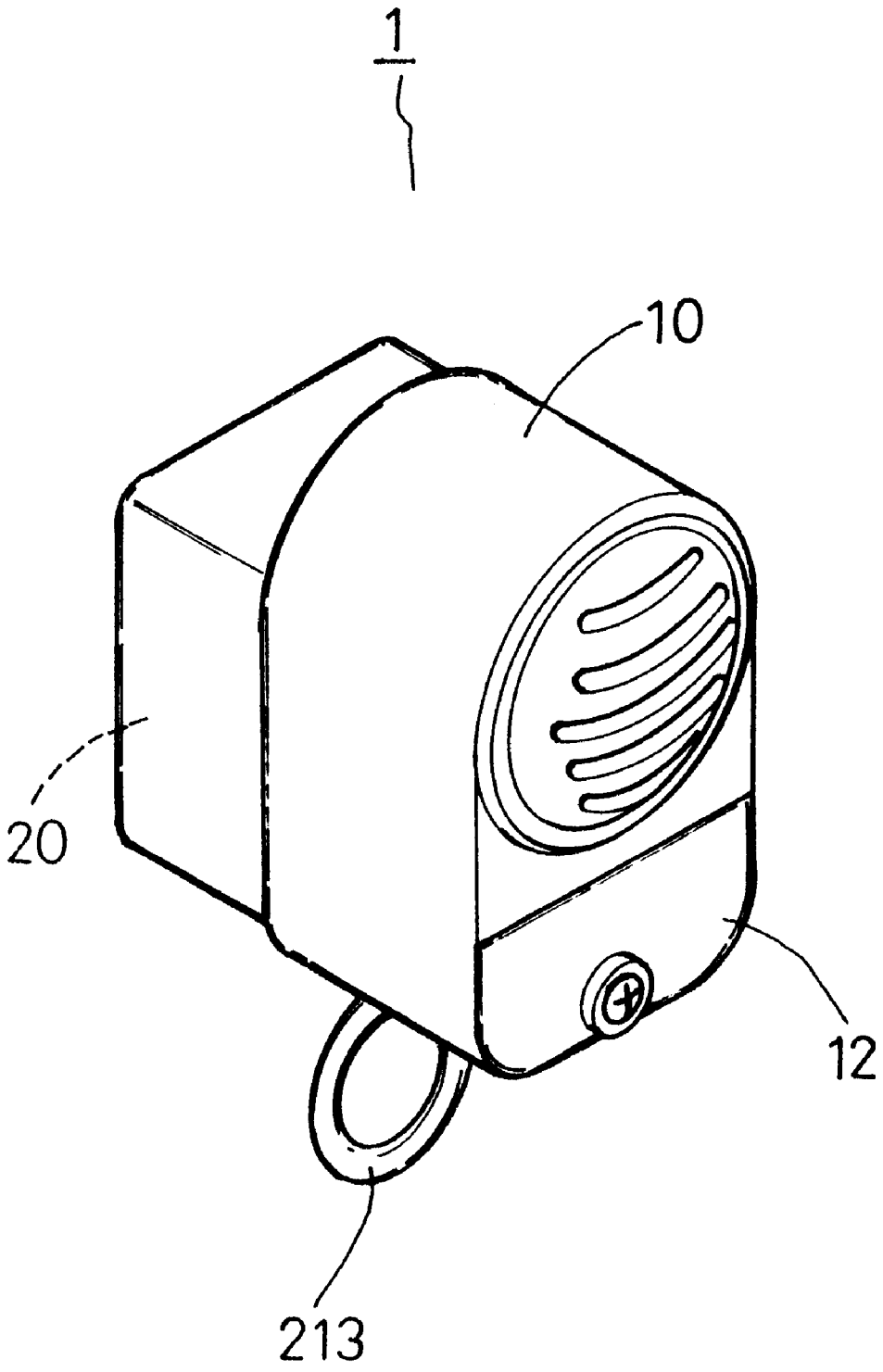
FIG. 1 is a perspective view of a simple device for producing both action effect and electronic effect in the present invention.
Figure 2:
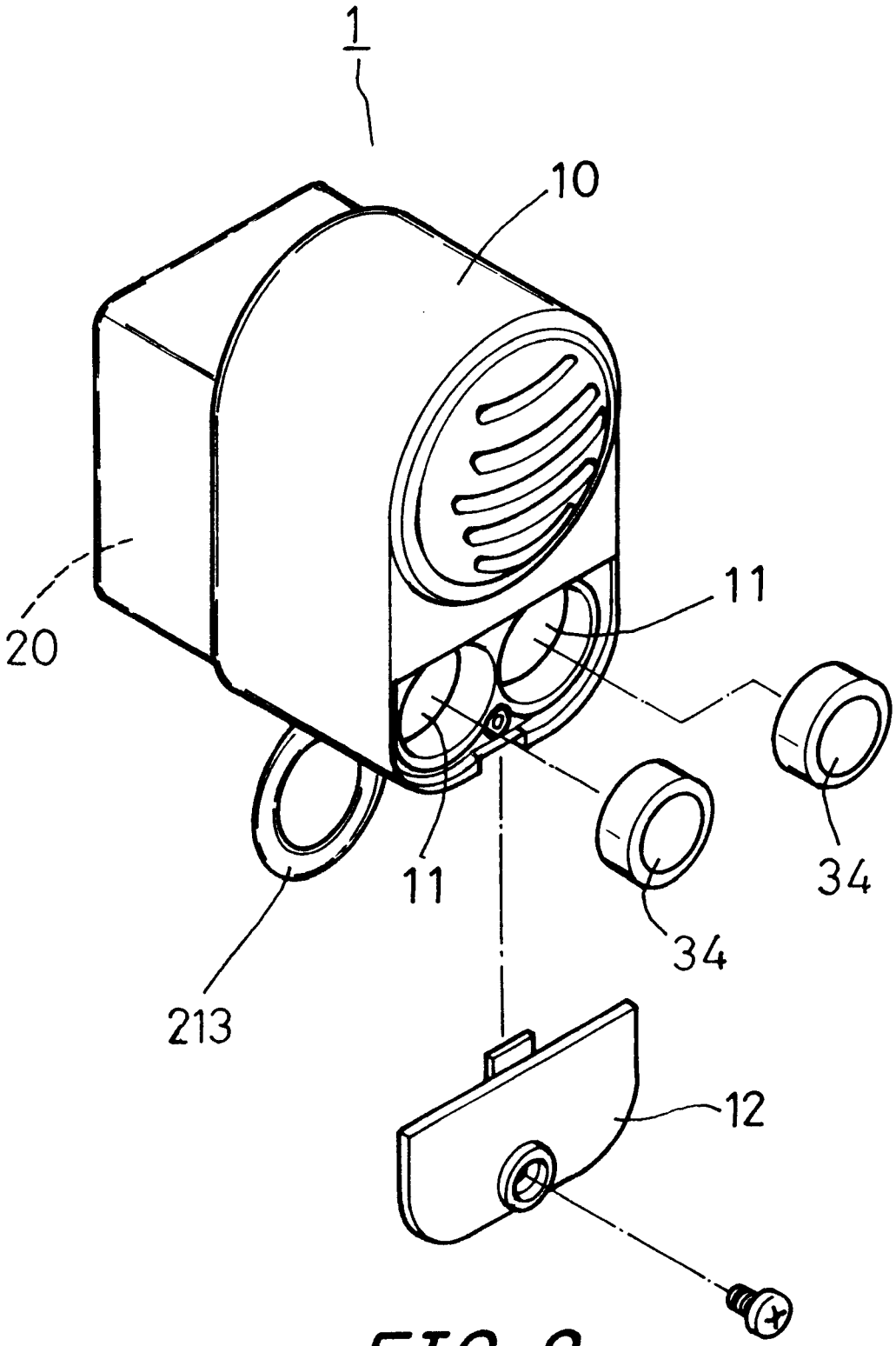
FIG. 2 is a partial exploded perspective view of the simple device for producing both action effect and electronic effect in the present invention.
Figure 3:
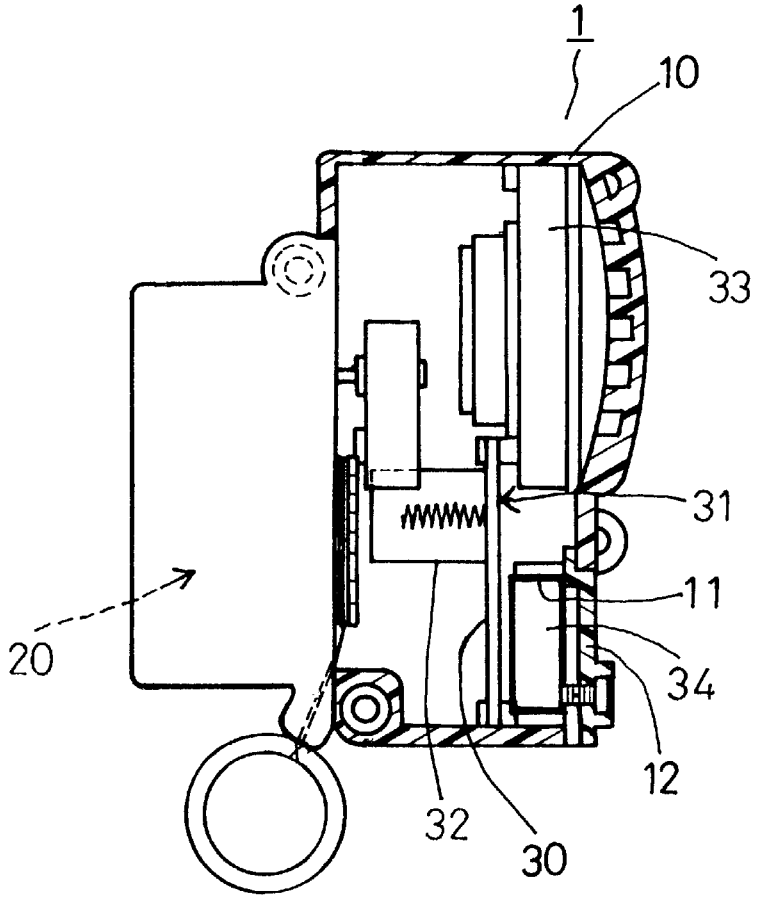
FIG. 3 is a cross-sectional view of in the simple device in the present invention.
Figure 4:
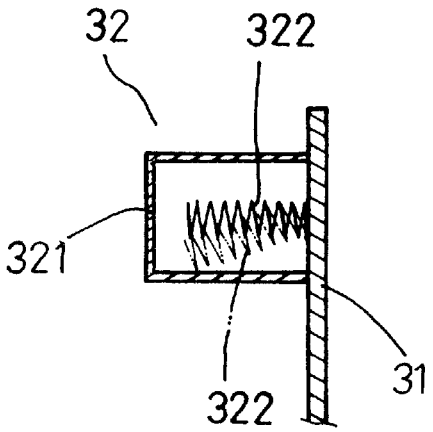
FIG. 4 is a cross-sectional view of a vibration sensor in the simple device in the present invention.
Figure 5:
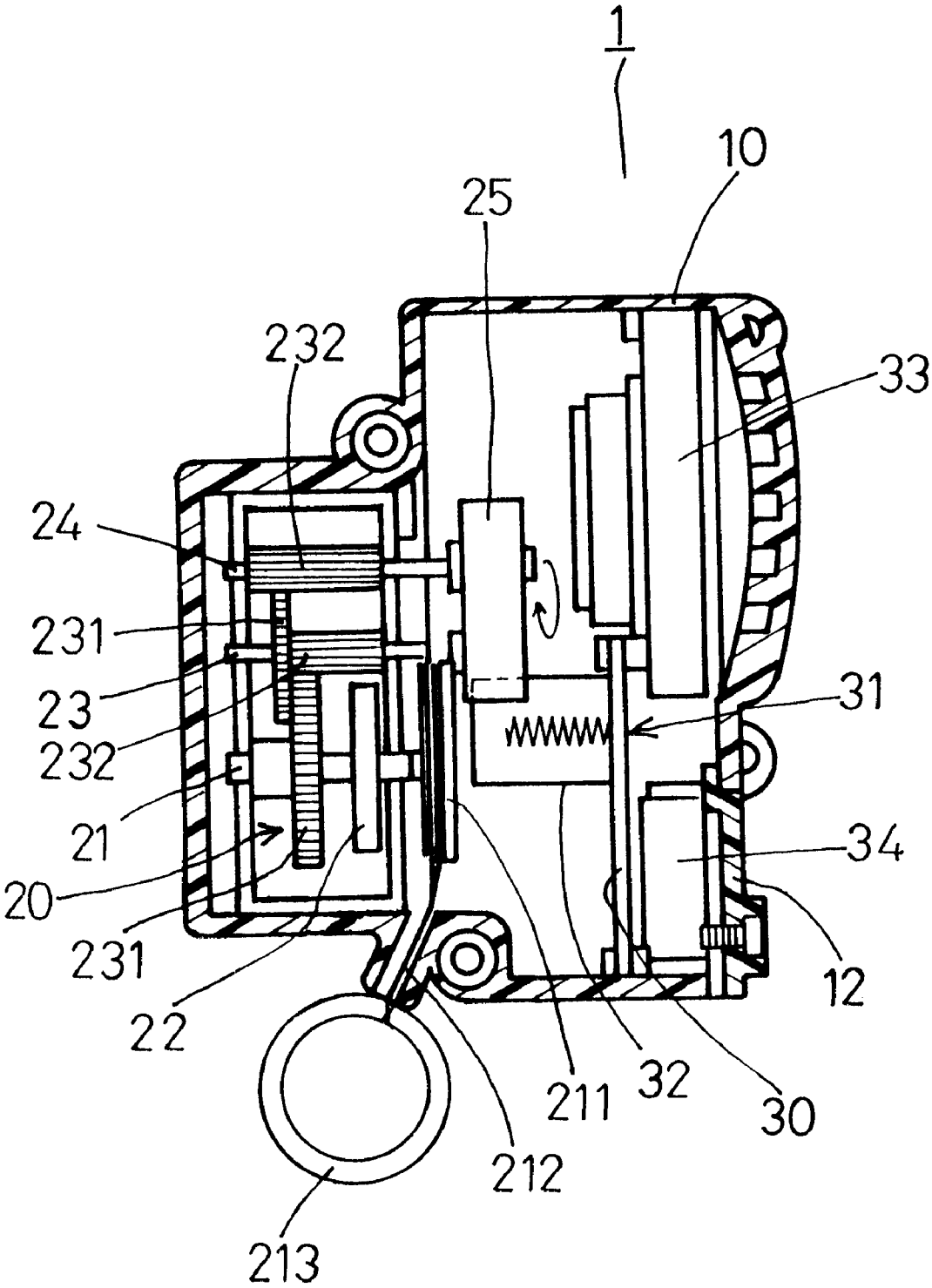
FIG. 5 is a cross-sectional view of the simple device in the present invention.

A preferred embodiment of a simple device for producing both action effect and electronic effect in the present invention, as shown in FIGS. 1 and 2, includes a housing 10 for containing other components, two battery chambers 11 formed in a front side of the housing 10, and a cap 12 closing on the two battery chambers, two batteries 34 contained in the battery chambers 11 as a power source. Further, as shown in FIG. 3 and FIG. 5, a transmitting shaft 21, a gear shaft 23, an output shaft 24 and an elastic driving mechanism 20 for an eccentric weight 25, an electronic control circuit 30 arranged on an electronic circuit board 31, a vibration sensor 32, an action device 33, and two batteries 34 are deposited in the housing 10.

As the electronic board 31 and the batteries 34 are to be connected with each other, the output of the electronic circuit board 31 is connected to the action device 33 controlled by the integrated circuit (IC) of the electronic board 31. Then the action device 33 can be driven by the circuit to accomplish preset actions. The electronic circuit 30 consists of an integrated circuit (IC) and several electronic components, and the action device 33 may be one for producing sound, lighting, etc., or some other action, and a sound producer is illustrated as the action device 33 in this embodiment.

The vibration sensor 32 is connected to the circuit of the electronic circuit board 31 to trigger the circuit by means of vibration or movement. And a wide variety of switches may be used as the vibration sensor 32, such as a spring vibration switch, a mercury switch, a ball switch, etc. The vibration sensor 32 used in the embodiment is a non-insulating housing 321 and a non-insulating elastic spring 322 fixed in the housing 321. Both housing 321 and spring 322 are connected to the electronic circuit board 31, and are or on the board 31, normally insulated from each other, thus functioning as two poles for triggering the electronic circuit. So when both housing 321 and spring 322 come into contact each other, they turn on the circuit of the electronic circuit board 31 to function, thus permitting the function device 33 to accomplish a preset action or function. The contact of the housing 321 and the elastic spring 322 may occur from vibration, causing the elastic spring 322 to sway to and fro and contact the housing 321. Of course, the sensibility of swaying (or sensibility of turning-on) of the elastic spring 322 has correlation with its material, property and size. But it is not discussed here, having no relation to the characteristic of the invention. It should be understood that the vibration sensor 32 is only responsible for triggering the circuit of the electronic circuit board 31, and is unnecessary for the elastic spring 322 to keep on contacting the housing 321. After one round of operation of the vibration sensor 32, it resumes a normally open condition as the vibration phenomenon gradually dies down.

As it is evident that since the energy produced by the vibration sensor 32 is only used to trigger the circuit of the electronic board 31, the vibration sensor 32 may be in a normally closed condition instead of a normally open condition. In other words, the elastic spring 321 normally contacts the housing 321, and leaves the housing 321 to trigger the circuit 30. And the vibration sensor 32 has does not necessarily require the housing 321 and the elastic spring 322, since other means such as a mercury switch or a ball switch having two conductive members to turn on or off power source can replace the sensor 32.

Further, an eccentric weight 25 is located beside the vibration sensor 32 preferably not to contact with each other, and rotatable at a rotatable high speed by the elastic driving mechanism 20 to produce vibration phenomenon to permit the vibration sensor 32 to trigger the circuit 30. The eccentric weight 25 is fixed on an outer end of an output shaft 24 of the elastic driving mechanism 20, which consists of the output shaft 24, a transmitting shaft 21, a gear shaft 23, respectively having a large and a small gears 231 and 232 for accelerating the output shaft 24 so as to produce vibration phenomenon caused by high-speed rotation. The transmitting shaft 21 may slow down a torque elastic member to prolong the vibration phenomenon for a while so that the housing 10 may produce vibration phenomenon. However, in practical design the output shaft and the transmitting shaft may be integrated as one without needing the gear shaft, the large or the small gear.

The elastic driving mechanism 20 is used to drive the output shaft 24 to keep on rotation for a certain period of time, forcing the eccentric weight 25 to produce vibration phenomenon. So it has the elastic spring 22 with one end fixed immovable, and with the other end connected with the transmitting shaft 21, wound inward to store resilience by force and release the stored resilience. In winding or unwinding process of the spring 22 energy may be produced to drive the transmitting shaft 21 to rotate in either of the two conditions. But the large gear 231 is preferably not rotated by the transmitting shaft 21 in case of winding of the spring spring 22, and to be rotated in case of unwinding of the spring 22. (Or the large gear 231 may have a ratchet tooth to engage with the transmitting shaft 21 to to perform the same effect.) So the transmitting shaft 21 and the large gear 321 are designed to have a kind of engaging condition wherein the gear 321 can be rotated by the shaft 21. And the spring 22 can be wound by many kinds of methods, using a rotating handle, or a rope winder 211, a rope 212 to be wound around the winder 211 and having one end extending out of the housing 10 and bound on a pulling ring 213. Then the pulling ring 213 can be pulled to wind the spring 22 to store resilience.

Figure 6:
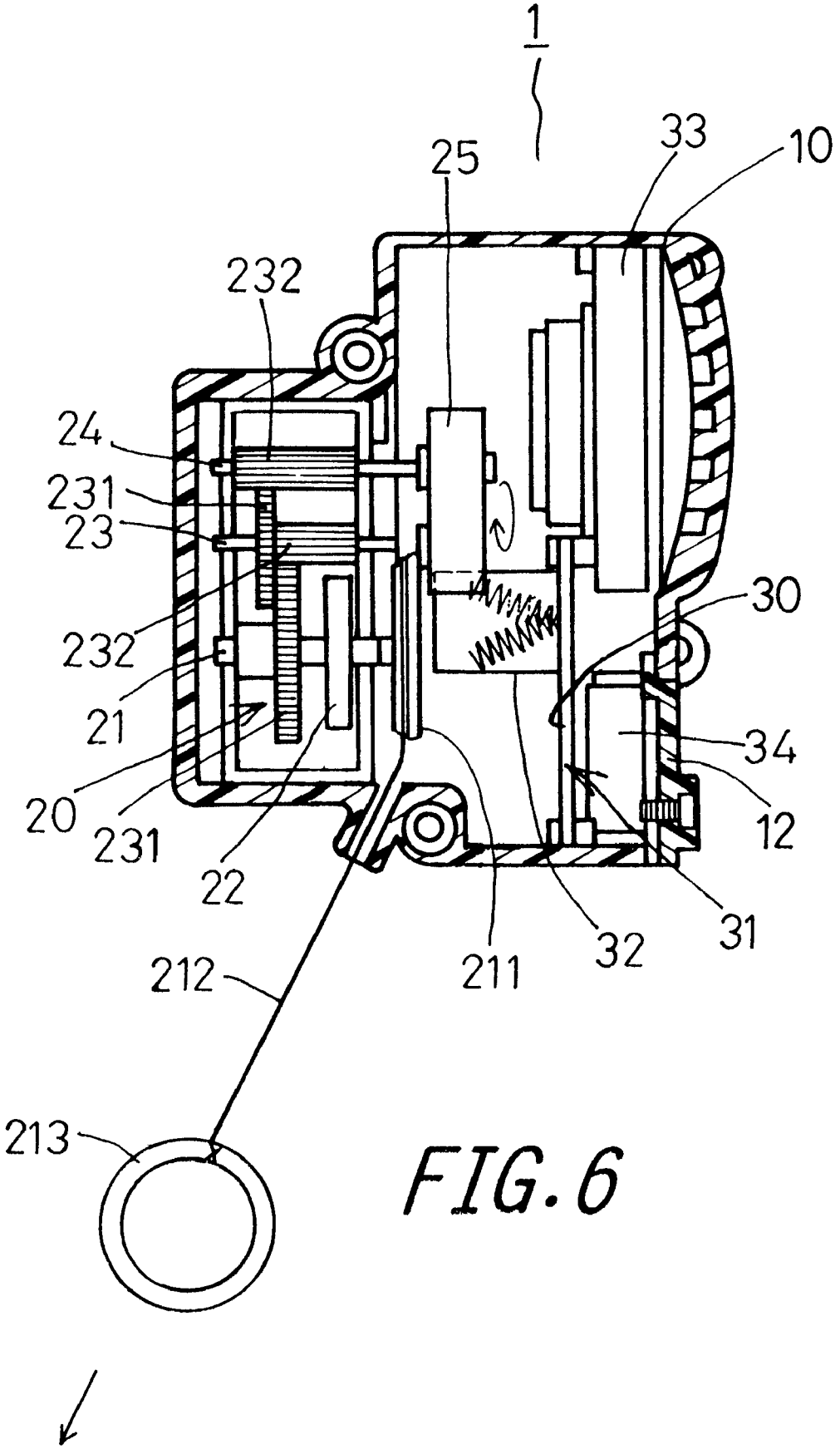
FIG. 6 is a cross-sectional view of operating the simple device in the present invention; and, FIG. 7 is a diagram of the simple device applied to a toy.

The simple device described above can be applied to a toy, as shown in FIG. 6, wherein the pulling ring 213 is pulled to force the elastic driving mechanism 20, with the eccentric weight 25 producing vibration phenomenon caused by high-speed rotation, and with the vibration sensor 32 vibrated to trigger the circuit of the electronic circuit board 31. Then the function device 33 is driven to produce preset action until one round of action is finished. When the pulling ring 213 is released, the spring 22 release its resilience to force the rope 212 wound back on the rope winder 211 as shown in FIG. 5, ready for the next round of operation.

The eccentric weight 25 is connected with the output shaft 24 to provide an eccentric action for producing eccentric function and the output shaft 24 may have one end output or two outputs to coordinate with an eccentric device to produce various actions including vibration. "Eccentric" means producing unbalanced rotation, so the eccentric action may be produced by an eccentric disc or cam without need of weight 25. An eccentric weight is illustrated in the present embodiment as an example. Any device can be used so long as it can produce an unbalanced action. Any kind of of device including an eccentric structure for producing vibration to cause action may be used.

The elastic driving mechanism 20 uses the elastic spring 22 as a power source for driving other components. However, it is evident that the elastic driving mechanism needs such a small resilience as to cause the eccentric member to rotate. So a compression spring or an expansion spring also can be used to store and release resilience for converting it into a force of driving the eccentric action member to produce vibration so as to trigger the circuit.

Figure 7:
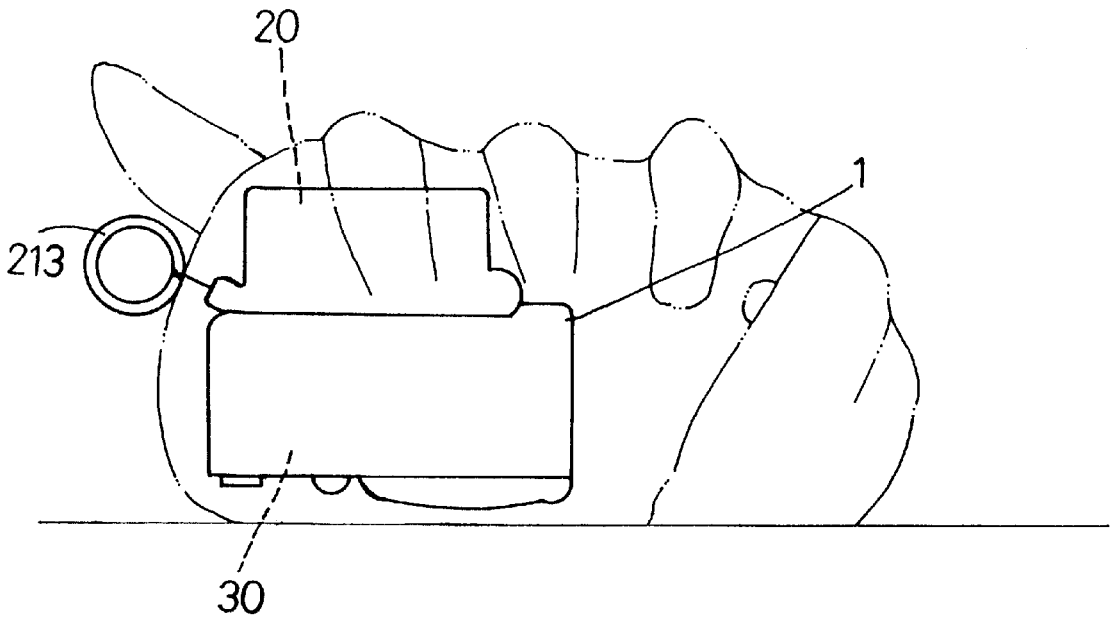

In the structure described above, the eccentric action member offers eccentric vibration phenomenon to trigger the electronic control circuit, not only producing electronic effect but also utilizing the eccentric vibration to move related action mechanisms to perform preset action. As shown in FIG. 7, the simple device 1 is wholly deposited in an animal-shaped toy, with the pulling ring 213 only exposed out of the toy. Then a user can pull easily the pulling ring 213, forcing the elastic driving mechanism 20 to rotate the eccentric weight 25 to produce vibration phenomenon. Then the vibration not merely triggers the electronic control circuit 30 but also rotates and moves the animal-shaped toy, performing action effect and "electronic effect" at the same time without using a motor. In addition, if a wheel and/or a spring and/or a crank and/or a connect rod are(is) fixed on the output shaft 24, various actions such as walking, running, jumping, etc. except vibration can be performed. These actions can be accomplished by provision of the eccentric action member.

As can be understood from the aforesaid description, the invention has the elastic driving mechanism for storing and releasing energy, which is used for producing vibration of the eccentric action member. And the vibration is a signal for driving both action effect and the vibration sensor for triggering the electronic control circuit, which then drives the action device to perform preset action. The signal of triggering the electronic control circuit is the vibration phenomenon, so it is an indirect triggering. As no motor is used in the invention, no complicated connecting mechanism is used to connect the elastic driving mechanism and the electronic control circuit in the invention. Thus the simple device in the invention can attain two objects of action effect and electronic effect, giving rise in interest for operating it, having low cost, easy assemblage, with various designs to be utilized in toys.

In general, the largest characteristic of the invention is the elastic driving mechanism with the eccentric action member for producing vibration for performing action, permitting the vibration sensor trigger the electronic control circuit. In addition, there are no direct connecting devices for connecting the action mechanism and the electronic control circuit. So this invention has originality and novelty. Besides, using no motor, this invention consumes very little electricity, and for example, the two button batteries AG13 can last 1000 rounds of use for the IC using 40 ma or so in six seconds in producing sonic electronic function. In other words, the simple device can produce more than 1000 rounds of interesting play and recreational worth including action effect and electronic effect. Further, it can contribute to maintain environment protection and lessen the cost.

While the preferred embodiment of the invention has been described above, it will be recognized and understood that various modifications may be made therein and the appended claims are intended to cover all such modifications which may fall within the spirit and scope of the invention.

I claim:

1. A simple device for producing both an action effect and an electronic effect comprising a housing, an elastic driving mechanism with an elastic member, and an electronic control circuit having a vibration sensor;

said housing containing said elastic driving mechanism with said elastic member and said electronic control circuit with said vibration sensor;

said elastic driving mechanism including an elastic member for storing and releasing resilient force and producing changeable energy in the storing and releasing process;

a transmitting shaft and an output shaft, said transmitting shaft connected to said elastic member for changing the condition of said elastic member, said elastic member recovering an original condition when a force applied to said transmitting shaft is removed; said output shaft being rotated by said transmitting shaft and connected to an eccentric action means for permitting said elastic driving mechanism to produce a preset action;

a power input mechanism connected to said transmitting shaft for receiving an exterior force and causing said transmitting shaft to rotate; and said eccentric action means being connected to and rotatable by said output shaft for producing an unbalanced rotation to cause vibration, and said vibration forcing said elastic driving mechanism to move said simple device and produce an action.

2. The simple device for producing both action effect and electronic effect and electronic effect as claimed in claim 1, wherein said eccentric action means of the elastic driving mechanism is separated from said vibration sensor of said electronic control circuit at such a distance that the force of the vibration produced by said eccentric action means is large enough to force said vibration sensor to trigger said electronic control circuit to produce an electronic effect.

3. The simple device for producing both action effect and electronic effect as claimed in claim 1, wherein said elastic driving mechanism is not directly connected to said electronic control circuit.

4. The simple device for producing both action effect and electronic effect as claimed in claim 1, wherein said transmitting shaft and said output shaft are connected with a plurality of gears for transmitting rotation to produce an action and vibration effect.

* * * * *